US007254852B2

(12) United States Patent
Martin

(10) Patent No.: US 7,254,852 B2
(45) Date of Patent: Aug. 14, 2007

(54) CUSHIONING DEVICE

(75) Inventor: Jeffrey D. Martin, Richmond, VA (US)

(73) Assignee: Carpenter, Co., Richmond, VA (US)

( * ) Notice: Subject to any disclaimer, the term of this patent is extended or adjusted under 35 U.S.C. 154(b) by 0 days.

(21) Appl. No.: 10/712,267

(22) Filed: Nov. 14, 2003

(65) Prior Publication Data

US 2005/0102756 A1 May 19, 2005

(51) Int. Cl.
*A47G 9/10* (2006.01)

(52) U.S. Cl. ..... 5/636; 5/736; 5/944; 5/953

(58) Field of Classification Search ..... 5/636, 5/655.9, 953, 944
See application file for complete search history.

(56) References Cited

U.S. PATENT DOCUMENTS

| | | | | | |
|---|---|---|---|---|---|
| 2,604,642 | A | | 7/1952 | Marco | 5/727 |
| 2,751,609 | A | | 6/1956 | Oesterling et al. | 5/420 |
| 2,785,739 | A | | 3/1957 | McGregor, Jr. et al. | 267/145 |
| 3,679,263 | A | | 7/1972 | Cadiou | 297/452.48 |
| 3,974,532 | A | | 8/1976 | Ecchuya | 5/724 |
| 4,020,511 | A | | 5/1977 | Terry | 5/636 |
| 4,070,719 | A | * | 1/1978 | Morgan | 5/736 |
| 4,092,751 | A | | 6/1978 | Burkholder et al. | 297/452.22 |
| 4,218,792 | A | | 8/1980 | Kogan | 5/636 |
| 4,320,543 | A | | 3/1982 | Dixon | 5/637 |
| 4,550,459 | A | | 11/1985 | Endel et al. | 5/640 |
| 4,673,605 | A | * | 6/1987 | Sias et al. | 428/120 |
| 4,726,087 | A | * | 2/1988 | Schaefer et al. | 5/636 |
| 4,768,251 | A | * | 9/1988 | Baskent | 5/722 |
| 4,777,855 | A | | 10/1988 | Cohen | 83/862 |
| 4,901,387 | A | | 2/1990 | Luke | 5/730 |
| D310,610 | S | | 9/1990 | Dixon | D6/601 |
| D317,236 | S | | 6/1991 | Dixon | D6/601 |

(Continued)

OTHER PUBLICATIONS

Contour Pillow, Memory Foam Pillow, Isotonic Pillows, "The Structure Memory Foam Pillow by Isotonic", pulled from internet at http://www.absolutecomfortonsale.com/pillow.htm, pulled from internet on Sep. 12, 2003, 3 pages.

(Continued)

*Primary Examiner*—Tara L Mayo
(74) *Attorney, Agent, or Firm*—Smith, Gambrell & Russell, LLP

(57) ABSTRACT

A cushioning device as in a pillow that has a main-body foam which a plurality of projections extend off a surface of the main-body. The projections are arranged in different support characteristic groupings such as rows of different volume or sized projections (e.g., cylindrical, cubical, prismatic, etc.) spaced out over a surface (e.g., convex surface) of the pillow (one or more surface sections as in upper surface sections and front edge surface section). There is also preferably provided a neck support ridge extension. The cylindrical projections are arranged such that a greater number of smaller volume, width or diameter, etc. rows of projections are centrally positioned on the surface and with the larger volume, width, or diameter, etc. projections laterally outward of the more centrally positioned projections, and with the ridge extension preferably extending along a front edge (e.g., commensurate with the extreme front edge surface or to some extent back in a front edge region of the front edge) of the pillow for a full length of the pillow.

38 Claims, 10 Drawing Sheets

U.S. PATENT DOCUMENTS

| | | | | |
|---|---|---|---|---|
| 5,025,519 | A * | 6/1991 | Spann et al. | 5/730 |
| 5,079,790 | A | 1/1992 | Pouch | 5/630 |
| 5,160,785 | A * | 11/1992 | Davidson, Jr. | 428/316.6 |
| 5,325,552 | A * | 7/1994 | Fong | 5/724 |
| D372,158 | S | 7/1996 | Bonaddio et al. | D6/601 |
| 5,689,844 | A | 11/1997 | Liu | 5/636 |
| 5,724,687 | A | 3/1998 | Kim | 5/633 |
| 5,960,497 | A * | 10/1999 | Castellino et al. | 5/730 |
| 6,151,735 | A | 11/2000 | Koby et al. | 5/644 |
| 6,327,725 | B1 | 12/2001 | Veilleux et al. | 5/644 |
| 6,415,467 | B1 * | 7/2002 | Bretvin | 5/710 |
| 6,560,803 | B2 | 5/2003 | Zur | 5/654 |
| 6,988,286 | B2 * | 1/2006 | Schecter et al. | 5/645 |
| 7,036,514 | B2 * | 5/2006 | Heck | 128/859 |
| 2002/0119270 | A1 * | 8/2002 | Daniel, Jr. | 428/36.9 |
| 2004/0019972 | A1 | 2/2004 | Schecter et al. | 5/645 |

OTHER PUBLICATIONS

Carpenter Company / Bedding—Omalon, pulled from internet at http://www.carpenter.com/Divisions/bedding_omalon.htm, pulled from internet on Sep. 12, 2003, 2 pages.

One page image pulled from internet on Sep. 12, 2003 at http//www.carpenter.com/ConsumerImages/isotonic_images/roll_iso1.jpg.

Isotonic Memory Foam Pillows, "Healthy Foundations", pulled from internet on Apr. 23, 2004 at http://www.healthyfoundations.com/pillows.html, 2 pages.

Comfort Zone Memory Foam Pillows, pulled from internet on Sep. 22, 2003 at http://www.memoryfoamoutlet.com/comfort%20zone%20pillow.htm, 3 pages.

Carpenter Company / Consumer Products—FOAM; pulled from internet on Sep. 12, 2003 at http://www.carpenter.com/Divisions/consumerprod_foam.htm, 2 pages.

Comfort Zone Memory Foam Pillow, 2 pages, not dated.

Sensafoam sleeping pillows the Perfect Pillow from the Texas Frontier Outfitters Store, pulled from internet on Sep. 22, 2003 at http://www.texasfrontieroutfitters.com/tfo-ra-te_perfectpillow.html 2 pages.

Guiseley Mobility: Comrie Deluxe Comfort Mattress, Massage Back Support, pulled from internet on Apr. 12, 2004 at http://www.guiseleymobility.com/comfort1.htm 3 pages.

* cited by examiner

CUSHIONING DEVICE

FIELD OF THE INVENTION

The present invention features a cushioning device with preferred embodiments directed at a pillow cushioning device, preferably a multi-zone foam pillow cushioning device such as one formed of a visco-elastic foam, with a preferred embodiment featuring a plurality of contact surface projections, as in cylindrical or circular cross-sectioned extensions (e.g. coils), that are preferably arranged in zones of different sizes or zones of different support characteristics, and extend out from a main support body.

BACKGROUND OF THE INVENTION

Pillows come in a variety of forms, with the more typical consisting of rectangular, fabric enclosures filled with feathers, down, chipped foam, or a polyester fill in a traditional overall shape (e.g., converging corners and a convex upper surface presented when supported on a bed). These pillows may be re-shaped by the user to provide reasonably adequate support for the user while the user falls asleep. However, many people suffer from an uncomfortable night's sleep because of the inadequate support that their head and neck receive while using these traditional pillows throughout the night. This is because traditional pillows either have a body that is so soft that the neck support area compresses to result in no support, or the body is so firm that the head sits considerably higher than the shoulders of the user, resulting in an abnormal sleeping position. Chronic neck pain or stiffness and a tense upper back are often the result of these inadequate forms of support these traditional pillows provide.

Various foam pillows have also been developed that comprise a foam body taking the place of the above-noted fillers and inserted into a fabric enclosure. These foam body pillows include polyurethane foam pillows (e.g. Omalux® high density foam sold by Carpenter Co. of Richmond, Va.) and also include visco-elastic foam pillows (e.g. the "PERFECT PILLOW® comfort support device and the ISOTONIC® pillow also sold by Carpenter Co.). Foam based pillows avoid problems such as filler clumping and can facilitate washing by allowing for easier removal of the pillow support from its fabric enclosure. However, even with a high quality foam body such as the polyurethane foam pillows noted above, the pillow can be deemed by some users to not adequately support the head and shoulders in a manner that is most comfortable to the user. This is because the prior art foam pillows are designed to generally present singular or unitary support characteristics over an entire head contact surface area of the pillow, and most prior art foam pillows are generally not well suited for heat dissipation. In an effort to provide added comfort, the prior art has relied upon expense increasing features as in, the addition of ventilation holes and/or extra layers of added material and/or added components such as adjustable air bladders. Thus, the foam pillows of the prior art are not well suited to provide varying degrees of support at targeted portions of the pillow to provide more comfortable support and/or have a tendency to provide poor heat dissipation and/or present highly complex and overly expensive designs.

Various examples of combination pillows can be seen in the multiple foam type/multiple layer arrangement in U.S. Pat. No. 5,689,844, the composite pillow of U.S. Pat. No. 4,777,855 and the visco-elastic pillow with added inflatable air bladder of U.S. Pat. No. 6,327,725.

SUMMARY OF THE INVENTION

The present invention is directed at providing a cushioning device such as a pillow providing desirable pillow support and feel characteristics while avoiding undue complexity or providing an improved support foundation for use with added features (e.g., the design of the present invention avoids a need for such added features as in added foam laminates, but is not intended to preclude the possibility of adding such additional features as in additional layers, ventilation holes, or inserts, etc.). The present invention also features a pillow that includes, for example, different firmness contact areas or zones, and which achieves a contour pillow functionality, even in a traditionally shaped pillow format. Thus, a preferred embodiment of the present invention features a multi-zoned cushioning device having projections, which in a preferred embodiment foam coils that are preferably cylindrical extensions or circular cross-sectioned extensions, although the projections can take on a variety of shapes as in squares, hexagons, triangles, etc. with their arrangement and dimensioning being such that the multi-zoned cushioning effect is achieved. The projections extend from a foam main body with the projections or coils preferably being of different sizes such as groups of different sizes to thereby facilitate providing the multi-zoned support.

The projections are preferably relatively large in cross-sectional area as compared to their extension distance off the main body such that they are highly stable, "stub-like" projections. Also, either all of the projections or those within a particular common group preferably extend for a common height off the main body so as to retain a preferred exterior cushion configuration that corresponds with that of the main body (e.g., a convex curvature in the main body in the front to rear cross-section). The projections further preferably present a flat exposed upper surface transverse to an axis of extension and preferably have a common periphery or diameter over their axial length/height (e.g., a cylindrical or prism configuration).

The present invention is also directed at providing a high comfort cushion which provides proper head and neck support for a variety of user positions. That is, the present invention is designed to maintain a high comfort level and proper head and neck support for a variety of head and neck placements commonly used by a person including a supine position (on the back) lying position, as well as stomach and side lying positions. The enhancement in head/neck support is facilitated by the providing of projections which are positioned and configured to enhance desirable pillow characteristics. In a preferred embodiment, the projections include similarly configured (e.g., cylindrical) extensions (e.g., foam coils) of different sizes and groupings to thereby provide multi-zoned different support characteristics. This includes, a visco-elastic cushioning device having a plurality of foam projections (e.g., a preferred embodiment features a monolithic body of foam which comprises the main body and integral projections extending thereoff, as along an upper side only). A suitable material for both the main body and projections includes, for example, a visco-elastic foam material such as Carpenter Co.'s brand 202-2507 low density visco-elastic foam.

A pillow having multiple groups (e.g., straight line rows) of projections (e.g. cylindrical extensions) is preferred with the projections (cylindrical extensions) in a given group or series (row) preferably being of a substantially uniform cross-section (radius) and/or height. For example, a preferred embodiment features cylindrical extensions in groups such as rows of common size projections with one row having a larger radius (peripheral area) than the extensions of a second row. More preferably, the cushioning device includes at least four rows of projections, as in four rows of cylindrical extensions, with the inner rows (e.g., two or more interior rows) having substantially uniform radii that are smaller than the radii of the cylindrical extensions of the outer rows (e.g., one or more rows external to the interior rows, as in one or more of the larger coil rows to each of the front/back sides of the one or more interior coil groups). With the same or relatively close to the same (e.g. within 15%) projection heights for each zone there is provided a larger and smaller projection volume relationship that coincides generally with the radius or peripheral cross-sectional area relationship (e.g., smaller radius projection are the smaller volume projections and are of the same height or slightly higher or slightly shorter than the larger radius coils).

The combination of the cushion's main body and projection heights, or the overall cushion's height, is preferably designed to be at a level to provide comfortable support to a user's head and neck when compressed. Moreover, the height and volume and cross-sectional configuration of the projections in a given row are preferably substantially equal or, in an alternate embodiment, the smaller size projections are taller than the larger sized projections, but preferably with the shorter projections having a height of at least 80% of the larger projection (e.g., 85 to 100%). Preferably, the shape and cross-sectional dimension is the same over the height of the respective projections. Thus, in a preferred embodiment featuring cylindrical projections, the cylindrical projections in a given row are substantially uniform with the average uniform height of the cylindrical projections in an inner row being greater than or equal to the average height of the cylindrical extensions in an outer row. A similar arrangement is also preferably applicable to when other shaped projections are involved as in squares, triangle, or less specific geometrical shapes, etc. This sizing can be based on a universal for all (adult and child) setting, or a universal for adult in use with a universal child size, or a series of different sizes (e.g., extra small, small, medium to extra large) designed for various dimensioned head and neck, and to user's preference.

The base forming main body of the cushion can be formed in a variety of pillow shapes, although the base is preferably formed in a shape that corresponds with a typical pillow configuration, at least relative to the exposed in use surface (s) thereof. For example, a rectangular configuration having converging front and back sides with peripherally rounded off corners, as well as a convex (in the direction transverse to the longer front/rear side walls) upper projection support surface. The vertical cross-section parallel to the long sides is preferably generally planar at the height level dictated by the height of the transverse convex cross-section. In other words, the top surface is preferably convex in the widthwise direction (the width of the pillow being the distance of extension in the direction of elongation of the user sleeping on the pillow), and flat or of a less convex nature relative to the lengthwise direction of the pillow. The bottom surface of the pillow can likewise be flat or convex, or a combination thereof, such as flat in the intermediate area and having both sloping up and rounded corner converging surfaces at the pillow corner convoluted, etc. Various other cushion types would dictate a preferred main body configuration as a preferred embodiment features a multi-zoned cushion that can match or closely approximate pre-existing cushions.

In a preferred embodiment, the cushion is formed having at least one outer ridge projection on the top surface of the main body that runs along a longitudianally extending edge of the main body commensurate with the front most edge of the top surface of the pillow and thus is located outside the outer row of projections also running in a lengthwise direction. The widthwise thickness of the preferably continuous raised ridge with sloped upper surface (e.g., a 1.5 to 3.5 inches or more preferably 2 inches widthwise thickness) is well suited for tucking in between the chin and shoulders of a user or for supporting the nape region of the back of the neck.

A preferred embodiment of the invention is also preferably symmetric both with respect to a central lengthwise extending cut and a central widthwise extending cut. For example, in a preferred embodiment a lengthwise running central cut differentiates the pillow into a front section and a rear section with the front section having a first lengthwise row of a smaller radius or width, preferably common-sized cross-sectional area set of projections, which set is positioned closest to the central cut, and a second row of projections, but of a larger radius or width, preferably of a common-sized cross-sectional area configuration. The second row is positioned more forward in the front section than the first row. In view of the preferred symmetrical arrangement, the rear section also features a first row of smaller sized projections closer to the lengthwise central cut and a second lengthwise extending row of larger sized projections closer to the rear edge of the cushion than the first row in the rear section. Also, in the preferred embodiment, featuring a ridge running lengthwise along the forward edge of the cushion, the preferred symmetrical arrangement places a second ridge of a common size and configuration (as with the symmetrically corresponding projections described above) along the lengthwise rear edge of the cushion.

The preferred projection configuration comprises solid bodies of foam extending up from the base with a central axis generally transverse to the underlying supporting surface of the main body (which is preferably convex in cross-section in the widthwise direction, but generally planar in the lengthwise direction). Also, within each row, the lengthwise spacing distance between projections is preferably equal with the spacing between the smaller projections preferably being less than the lengthwise spacing between the larger projections. The spacing in the front-to-rear direction between rows of different sized projections is preferably greater than each of the aforementioned spacings in the lengthwise direction and of a common value along the length of each row but preferably varying in spacing distance in going from row to row in the front-to-rear direction relative to the different zone types. In view of the symmetrical nature of the pillow, the user need not worry about which front-to-rear orientation is involved with the pillow, although in an alternate embodiment, a non-symmetrical arrangement is featured having different projection and/or ridge relationships that present different front and rear section support characteristics.

When a ridge is provided it preferably features an outer convex surface facing outward away from the interior of the pillow and a planar inner wall preferably arranged generally transverse of the main body exposed surface (e.g., slopes downwardly and inwardly from the interior upper edge of the convex portion of the ridge to the underlying convex main-body). The ridge wall's base is preferably spaced from the adjacent most row by a spacing amount commensurate or less relative to the front-to-rear spacing of the lengthwise rows in the corresponding front or rear section. Also, the front-to-rear width of the ridge is preferably about equal to (within 15%) or falls between the value of the diameter or maximum dimension of the larger projections and the smaller projections. In a preferred embodiment, the ridge front-to-rear width is about equal to the diameter of the large coils and greater by about 20 to 30% to the smaller coils' diameter.

The preferred projections also preferably have essentially a common horizontal cross-sectional value going from the base of the projection to the exposed upper surface. The upper edge of each projection can have a sharp edge border between the side wall and top wall of the projections or have a rounded off upper edge. Alternate embodiments of the invention feature variable or non-common cross-sectional configurations as in sideways "V" or "C" annular recesses in the intermediate height region of the projections. However, in view of the preferred stub-like configuration non-recessed side walls are preferred.

Also the height of the various projections is preferably about 15 to 40% of the overall height of the pillow and more preferably about 30%±5% (e.g., 28%±2% with 1 inch projections and a 3.5 inch maximum thickness base being illustrative).

The preferred spacing arrangement and size of the projections relative to the overall exposed user contact surface of the pillow provides for a ratio between projection surface area over the entire upper surface area from an upper front edge to an upper rear edge of the main body cushion base. In a preferred embodiment this ratio is 70 to 90% with a sub-range of 75 to 85 being well suited and a value of about 80%±3% preferred (e.g., a 23×16.5 inch rectangular pillow with two 2 inch thick ridge extensions, two rows of 7 in number larger coils of 2.25 inch diameter and two rows of 9 in number smaller coils of 1.75 inch diameter smaller coil surfaces representing about 81% of the total exposed surface area). The percentage of exposed surface area presented by the larger projections (preferably a single row inward of each of the respective ridges) relative to the overall upper pillow contact surface area is preferably 20 to 40% or 25 to 35% which represents a preferred sub-range and 30%±2% being a suitable value for many uses. The percentage of overall contact area of the smaller projections (the sum of those in the front and rear cushion sections as above with the larger projection) is preferably the same as that presented by the lesser number, larger sized coils—or within 15%. The ridges preferably constitute about 20 to 30% of the overall upper pillow surface area or 25±2%.

Also, the interior, smaller sized projections (e.g., two centralized rows with one in each of the front and rear sections) preferably occupy a central region of the cushion with a percentage of occupation (e.g., from a lengthwise cut line intermediate the spacing between adjacent large and small projection rows in each of the front and rear sections) of 25 to 50% more preferably, 30 to 40% with 33%±2% being well suited for many uses for the present invention. The total area occupied by the sum of the larger section projection groupings (each taken from a lengthwise cut line adjacent the different size rows of projections to an intermediate cut line between an adjacent ridge and an adjacent larger size projection row) preferably occupies 25 to 55, or more preferably 30 to 45, with 36±2% representing a suitable value. The remainder of overall pillow surface area occupied by the ridge sections (from the above noted cut line adjacent the ridge to the exterior edge of the pillow in plan) is represented by a preferred range of 15 to 45, or more preferably 20 to 40, with 30±2% being a suitable value.

The sizing and spacing of projections in a preferred embodiment provides for multiple projection contact with the head regardless of head positioning. For example, in a preferred embodiment, in addition to ridge contact with the neck region of the user, at least two full large projections and preferably at least twice as many smaller projections provide head support (e.g., full contact over exposed surfaces or the sum of partially and full contacted contact surfaces). For example, in a preferred embodiment, 2 to 2.5 large projections provide head/face contact support while 4 to 6 smaller projections provide head contact support.

The invention further includes a pillow comprising a foam main-body with a plurality of foam projections extending off of a surface of the foam main-body, and with said projections being in first and second groups which define different support characteristic zones. The projections are preferably of a foam material as in a visco-elastic foam material. Also, a preferred embodiment includes a first row of cylindrical foam projections and a second row of cylindrical foam projections and a top surface of the cylindrical projections in the first row preferably has a larger radius maximum width, and/or volume than the top surfaces of the cylindrical projections in the second row. Also, the entire pillow is preferably formed of a foam material as in a monolithic foam body with a pillow is formed entirely of visco-elastic foam material being preferred.

In one embodiment of the invention, a first group of projections includes multiple rows of a first size projection and said second group of projections include multiple rows of a second size projection, as in each group being of different size cylindrical projections. In a preferred embodiment there is included a first group of multiple rows of projections that includes a pair of laterally spread apart longitudinally extending rows of projections in a central region of the surface of said foam main-body, and wherein said second group of multiple rows of projections include a pair of longitudinally extending rows of projections that are positioned to opposite lateral sides of the pair of the longitudinally extending rows of the projections of said first group in the central region. Also, in this embodiment, the projections of said first group are smaller in volume than the projections of said second group, and preferably the projections within said first group are of a common size and configuration within said first group, and wherein the projections within said second group are of a common size and configuration within said second group.

Also, in a preferred embodiment, the main-body and projections are preferably formed of a visco-elastic foam material having a density range of 2.0 to 3.0 pcf, and said projections of said first group and said projections of said second group are of a common general shape with the pillow preferably further comprising a third projection group spaced from the first and second groups of projections. In addition, first projection group preferably includes laterally spaced apart longitudinally extending rows of projections, and said second group of projections include longitudinally extending rows of projections of larger size or volume than the projections in said first group, and longitudinally extending rows of said second projections being positioned to opposite outer lateral sides of said first group projections and wherein said third projection group comprises first and second extension ridges extending longitudinally and positioned to opposite lateral sides of said second group of projections. Also, first and second extension ridges are provided respectively, at the front and rear edges of said main-body and extend longitudinally from end to end at the front and rear of said pillow, and also wherein said surface of said main-body has a convex curvature that extends preferably in at least a lateral direction or only in a lateral direction. Furthermore, the projections in said first and second groups preferably have an average cross-sectional width value that is greater than a distance of extension of said projections transversely off a supporting surface of said main-body, and wherein said distance of extension of said first and second groups is within 15% of each other. In an alternate embodiment of the invention there is featured a pillow, comprising a main-body, projections arranged in a plurality of rows of said projections extending off said main-body, and said projections including a first type of projection having a first support characteristic, a second type of projection having a second support characteristic and a third projection type, with said first, second and third projection types being arranged on said main-body to define first, second and third different support characteristic zones, and wherein said first type of projection preferably includes laterally spaced apart longitudinally extending rows of projections and said second type of projections includes laterally spaced apart longitudinally extending rows of projections, and wherein third projection type includes a longitudinally extending ridge extension or two or more of the same spaced laterally apart as in one at each front and rear edge of the pillow. Also, in a preferred embodiment said first, second and third projection types are arranged laterally in a sequence of first ridge extension, first longitudinal row of second type projection, pair of longitudinal rows of first type projections, second longitudinal row of second type projections and second ridge extensions, and the pillow preferably has a symmetric relationship with respect to projection types about a centrally located longitudinal cross-section line. Also, said first and second projection types preferably have compressive force deflection (CFD) values of 0.35 to 0.55 lbs and 0.60 to 0.80 lbs, respectively, with a density range of foam forming said first and second projection types of 2.0 to 3.0 pcf and wherein said first projection type is more centrally positioned than said second projection type.

In an additional embodiment of the invention there is featured a cushion having a main-body of foam, a first foam ridge extension extending along a front edge region of said main-body, a first row of foam projections of a first projection type, a central zone of foam projections of a second projection type, and with said first row of foam projection of said first projection type being positioned laterally between said first foam ridge extension and said central zone of foam projections. Also there is further preferably provided a second row of foam projections of the first projection type which is positioned to an opposite lateral side of said central zone as said first row of foam projections of said first projection type, and wherein a second foam ridge extension is preferably positioned laterally rearward of said second row of foam projections of said first projection type.

In an additional embodiment of the invention there is featured a unitary foam pillow comprising a main body having a longitudinal length and a lateral width and a convex upper surface and a plurality of projections extending up of said convex upper surface and arranged in different support characteristic groupings and wherein said projections preferably include a first group that is greater in number and smaller in projection volume relative to a second group that is less in number but greater in projection volume and wherein said projections in said first and second groups preferably have essentially a common height and maximum width of the projections in said second group is greater than that of said first group. The seat cushion is also preferably in the form of a pillow wherein the projections are preferably cross-sectional projections with there being further provided a longitudinal ridge of extension position for neck contact.

DETAILED DESCRIPTION OF THE INVENTION

Figure 1:
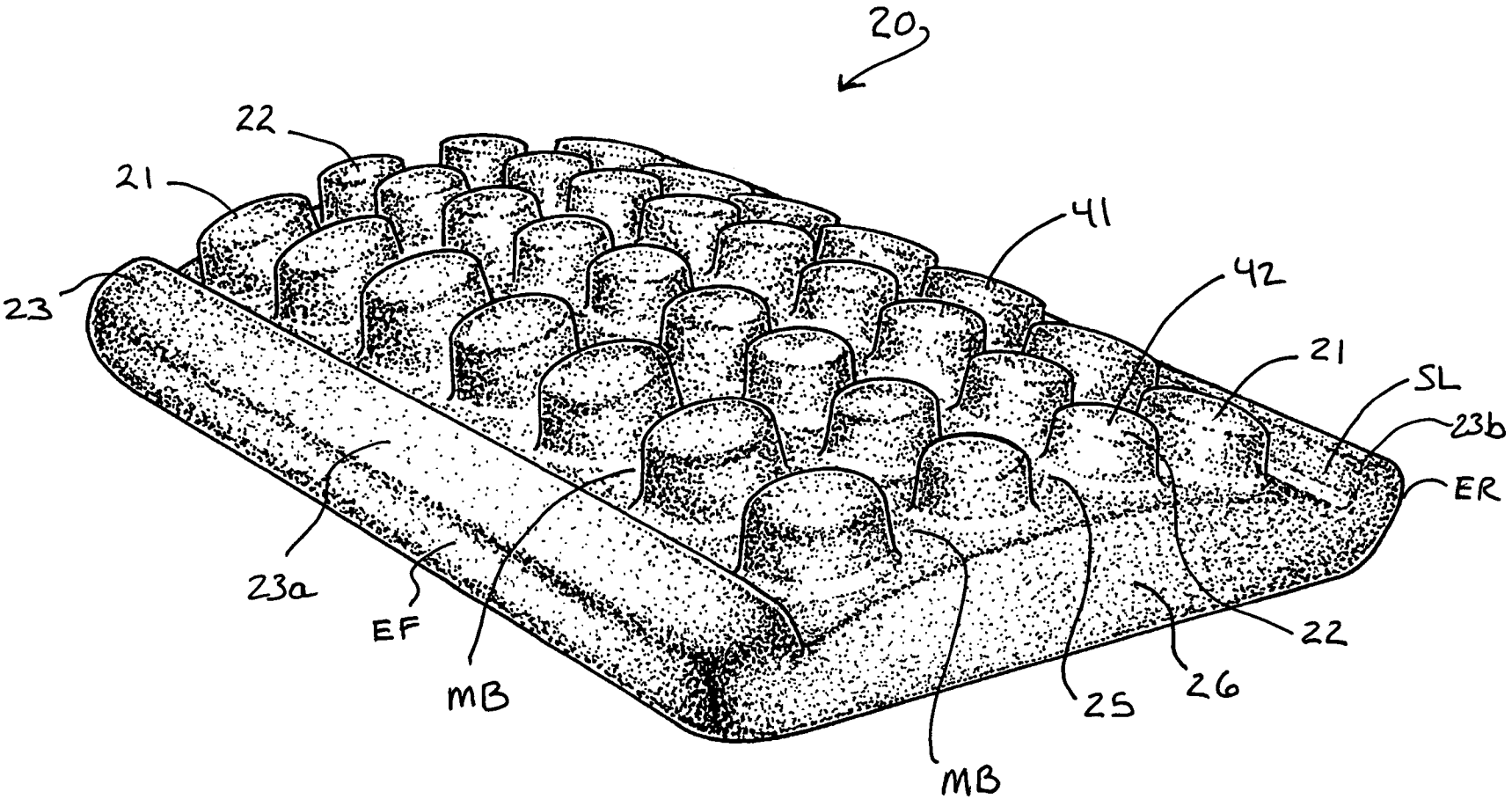
FIG. 1 shows a perspective view of a first embodiment of the pillow of the present invention.
Figure 2:
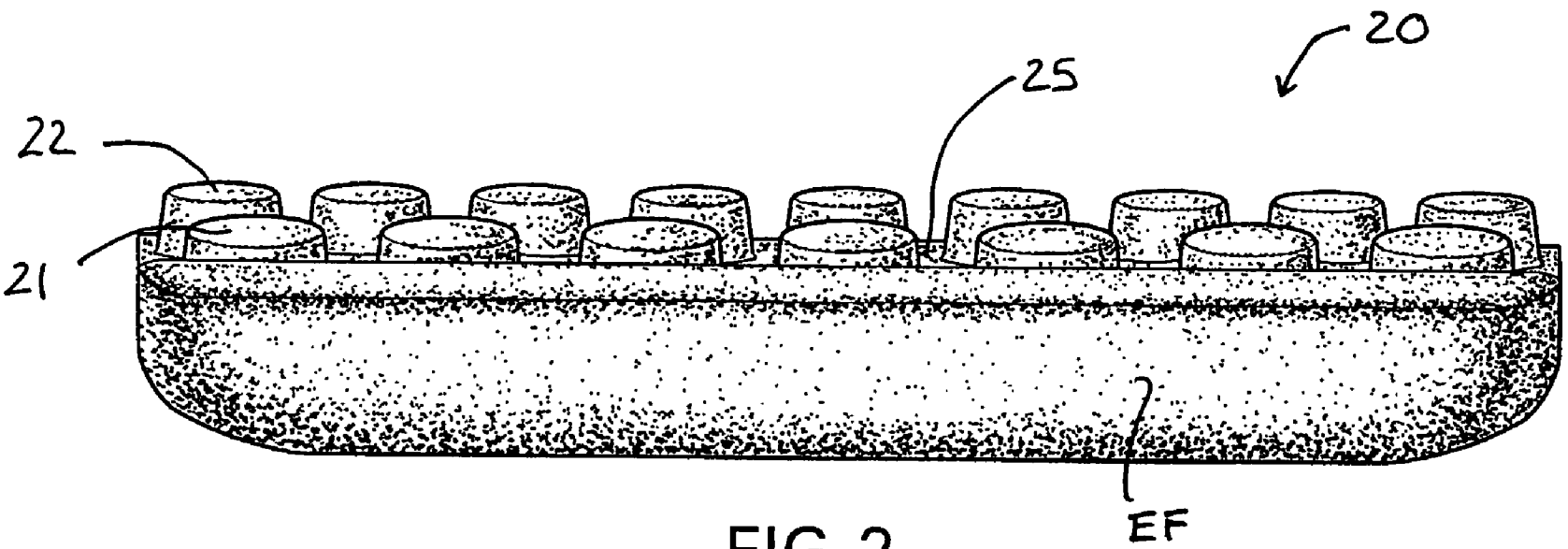
FIG. 2 shows a front side elevational view of the pillow of FIG. 1.
Figure 3:
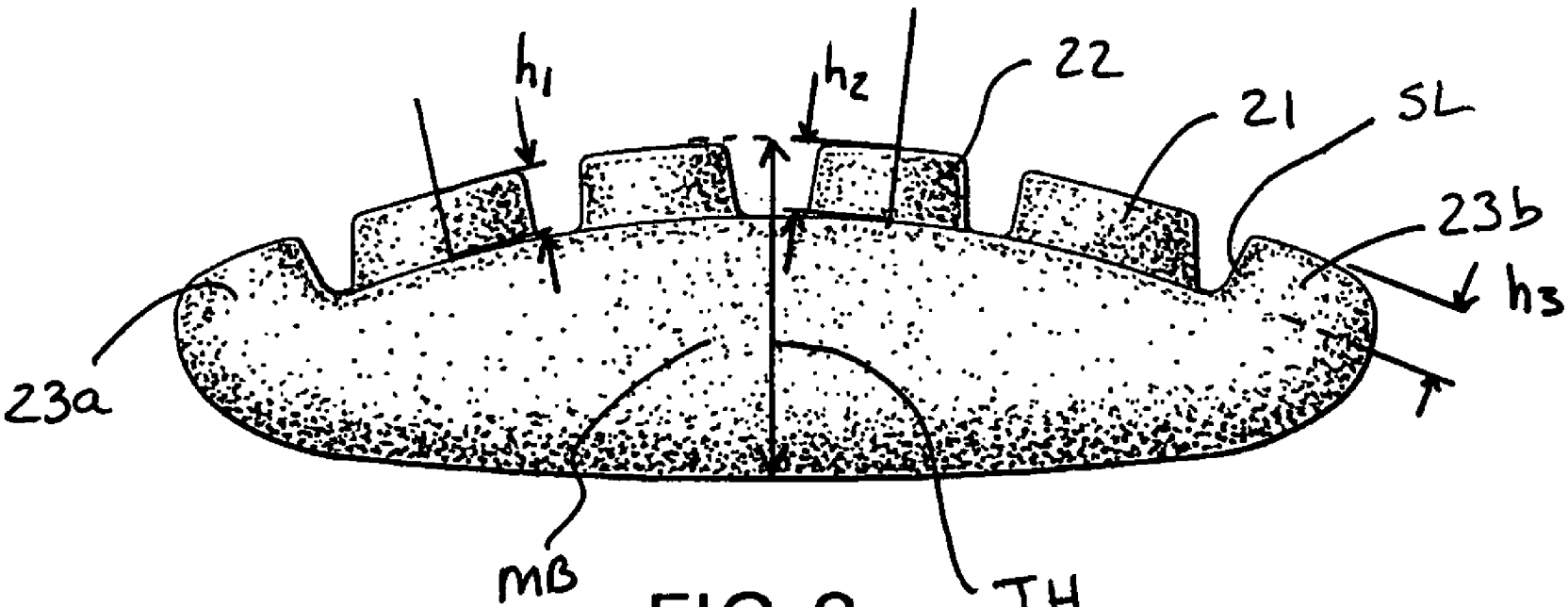
FIG. 3 shows a right end elevational view of the pillow of FIG. 1.

FIG. 1 illustrates a perspective view of the cushioning device 20 of the present invention. As shown in FIG. 1, cushioning device 20 is preferably a monolithic, unitary body formed of a cushioning material while any cushioning material which can achieve the features of the invention described above and below as in providing multi-zone support, a preferred embodiment features a monolithic body of low density, visco-elastic foam "202-2507" visco-elastic foam of Carpenter Co. of Richmond, Va. Various other materials are possible including alternate foam materials such as "High Resiliency" polyurethane foam (e.g., Omalux® foam), also of Carpenter Co. of Richmond, Va., and "Conventional" foams, as well as other preferred types of cushioning material preferably of the solid block type such as natural and synthetic rubbers. A solid block of visco-elastic foam material is preferred, however, to provide the desirable conforming contact support and feel characteristics described above and further below. The foam body is preferably used solely with an outer protective covering (e.g., a single cotton or velour type cloth cover with zipper or fold access and with or without intermediate filler material and typically, in use, is covered with as additional outer "pillow case" covering) and free of any added features as discussed above, although other arrangements are featured. For example, reference is made to U.S. patent application Ser. No. 10/209,193, which is incorporated herein by reference and features a multi-pocket design with different filler material above and below an intermediate foam core. The present invention's foam pillow represents a suitable core replacement in that design (e.g., preferably with a modified above/below convex contact surface configuration with a mirror image above/below projection arrangement or alternate projection arrangements for each support surface and with each contact surface configuration preferably falling within the various ranges described herein).

The illustrated cushioning device 20 has numerous projections preferably arranged in grouping of different sizes as in the illustrated large sized projections 21 and small sized projections 22. Each of the large and small sized projections 21,22 are shown in the preferred cylindrical or circular cross-sectioned extension configuration (e.g., foam body coils). As shown in FIG. 1, preferably the cushioning device 20 has multiple rows of the low density small and large sized coils 21, 22 and more preferably two longitudinal rows of each size for a total of four rows. Preferably, the outer rows include the larger diameter coils 21 with the smaller diameter coils 22 provided in the inner rows. As illustrated, the smaller size coils are arranged in adjacent interior rows and the larger sized coils arranged with the smaller coil rows therebetween. Also, the outer coils 21 are also generally spaced apart from each other in the lengthwise direction at a greater distance than are the inner coils 22. Thus, creating a multi-zoned cushion contact surface effect.

As explained in greater detail below, relative to size, the height of the cushioning device, including the coils 21, 22 and the main body MB from which they extend, is designed to provide support for the user's head and neck while maintaining a non-bottoming out, high comfort level.

In a preferred embodiment, a foam block such as of a visco-elastic foam material is utilized (e.g., a molded body having the final desired configuration or a block that is subject to one or more cutting or convoluting processes to produce the desired resultant multi-zoned coil arrangement, as in a heated wire cutting operation and/or convoluted roller removal process). The foam relied upon is designed to provide a high degree of comfort while still achieving the desired level of support (preferably without bottoming out under the high end of loads anticipated) and thus a variety of other foam types are also featured under the invention. To facilitate a discussion of the preferred characteristics of the foam material of the present invention reference is made to the below provided definitions from the Polyurethane Foam Association "PFA" with the noted ASTM test protocols (most current edition as of the present application filing date) being incorporated herein by reference.

Indentation Force Deflection (IFD)—A measure of the load bearing capacity of flexible polyurethane foam. IFD is generally measured as the force (in pounds) required to compress a 50 square inch circular indentor foot into a 4 inch thick sample, typically 15 inches square or larger, to a stated percentage of the sample's initial height. Common IFD values are generated at 25 and 65 percent of initial height. (Reference Test Method ASTM D3574). Note: Previously called "ILD (Indentation Load Deflection)".

Compression Force Deflection (CFD)[1]—A measure of the load bearing ability of a foam. It is the force exerted against a flat compression foot larger than the specimen to be tested. The value can be expressed at 25%, 40%, 50%, and/or 65% compression (ASTM D3574). Note: previously called "CLD (Compression Load-Deflection)". CFD measurements are frequently made at 25%, 65% or other height compressions. L6 [1]For undersized foam Samples (e.g., less than a square surface area of 15"×15"), CFD (compression Force Deflection) is often used instead of IFD. CFD is force in pounds required to compress an entire sample surface area to 50% sample height deflection. The CFD measurement is made using the same laboratory equipment as in the IFD procedure. To perform a CFD measurement, a sample with minimum surface dimensions of 2"×2", and a thickness of ¾", is required. The maximum height for CFD measurement is limited to 75% of the width or length of the sample size. So, a 4"×4" sample could not be thinner than ¾or thicker than 3". Surface area is also limited to a size that can be completely covered by the compression plate. To make a CFD measurement, the entire surface of the foam sample is compressed beneath the plate.

Compression Modulus—This is generally referred to as representing the ratio of a foam's ability to support force at different indentation (or compression) levels. It is determined by taking the ratio of the foam's IFD at 25% indentation and 65% indentation (65% IFD/25%). The compression modulus is typically a function of foam chemical formulation and the manufacturing process. In most cases, the higher the density the greater the compression modulus. Other terms that are used interchangeably are: support factor, and modulus.

Density—A measurement of the mass per unit volume. It is measured and expressed in pounds per cubic foot (pcf) or kilograms per cubic meter (kg/m$^3$) (Test Method ASTM D3547).

High Resilience (HR) Foam—A variety of polyurethane foam produced using a blend of polymer or graft polyols. High resilience foam has a less uniform (more random) cell structure different from conventional products. The different cell structure helps add support, comfort, and resilience or bounce. High resilience foams have a high support factor and greater surface resilience than conventional foams and are defined in ASTM D3770.

Hysteresis—The ability of foam to maintain original support characteristics after flexing. Hysteresis is the percent of 25% IFD loss measured as a compression tester returns to the normal (25% IFD) position after measuring 65% compression. Lower hysteresis values, or less IFD loss are desirable. Current research indicates that hysteresis values may provide a good indication of overall flexible foam durability. Low hysteresis in conventional foam is equal to less IFD loss.

Support Factor (see Compression Modulus)—represent 65% IFD/25% IFD determined after one minute of rest or recovery. When the support factor is known it can be used in conjunction with a known 25% IFD value to determine the 65% IFD value. Foams with low support factor are more likely to bottom out under load.

Elongation—The percent that a specially shaped sample will stretch from its original length before breaking. (Test Method ASTM D3574).

Tear Strength—A measure of the force required to continue a tear in a foam after a split or break has been started and expressed in pounds per inch (lbs/in.). This property is useful in determining suitability of foam in applications where the material is sewed, stapled, or otherwise anchored to a solid substrate. Also of interest with respect to demoldability. (ASTM D3574).

Tensile Strength—The pounds per square inch of force required to stretch a material to the breaking point. (Reference ASTM D3574).

Humid Aging—An accelerated aging test method under conditions of high humidity and temperature. (ASTM D3547).

Also, "visco-elastic foam", which can be referenced by way of density, CFD, etc, also has the characteristic of assuming the shape of a compressing body and returning in a somewhat "reluctant" manner upon removal of the compressing body. Thus, a representative visco-elastic foam can be characterized by the following: A solid steel ball that is dropped vertically downward from a height of 1 m and by gravity lands on a plane surface of the visco-elastic foam has a rebound vertically upwards of less than 10%, i.e., a rebound of less than 10 cm upwards from the plane surface of the visco-elastic foam.

Table I below provides some illustrative preferred characteristics for the foam material used in forming preferred embodiments of the invention with the "value" column representing tests carried out on the illustrated embodiment formed as a monolithic body with Carpenter Co. low density (202-2507) visco elastic foam with a main body referring to the solid (no projection) surface of the pillow, as in the border or the back.

TABLE I

| Characteristic of foam for use in the cushioning device of the present invention with a visco-elastic foam preferred | Preferred Range Values | Preferred Inter-mediate Range Values | Preferred Value(s) |
|---|---|---|---|
| Core or Main Body Density, pcf | 2.00-3.00 | 2.25-2.75 | 2.34 |
| 25% IFD, lbs | 4.0-6.0 | 4.5-5.5 | 5.1 |
| Tensile, psi | 4.50-6.50 | 5.00-6.00 | 5.63 |
| Elongation, % | 250-310 | 270-300 | 287 |
| Tear, ppi | 0.45-0.70 | 0.55-0.65 | 0.59 |
| 75% Compression Sets | | | |
| As received, %: | 65-80 | 70-75 | 73 |
| Humid aged, %: | 70-85 | 72-80 | 75 |
| CFD (small circles), lbs | 0.35-0.55 | 0.40-0.50 | 0.45 |
| CFD (large circles), lbs | 0.60-0.80 | 0.65-0.75 | 0.69 |
| CFD (solid zone), lbs | 0.75 | 0.90 | 0.81 |
| % Difference Circle Firmness (large vs. small) | 25-45 | 30-40 | 35 or $\left[\frac{.69-.45}{.69}\right]$ |
| % Difference Circle Firmness (solid vs. large) | 5-25 | 10-20 | 15 |

The illustrated multi-zoned cushioning device 20 of the present invention is designed to provide a proper level of support to a region of the user's head and neck by way of presenting a multi-zone support surface to the head being received thereby.

As shown in FIGS. 1-4 and 6-9, the upper surface 25 of the cushioning device 20 includes front sections FS and rear sections RS (FIG. 4) as well as large coils or projections 21 extending transversely up from the underlying plane of the upper surface 25 at a height of $h_1$ and small coils or projections 22 extending from the upper surface 25 at a height of $h_2$ relative to the underlying plane upper surface 25 of cushion 20. In a preferred embodiment, the upper surface 25 is convex in shape, in the widthwise direction with the lengthwise direction preferably being planar at the various levels presented by the convex widthwise curvature or with a convex lengthwise configuration at a radius greater than that of the widthwise direction. The illustrated large coils 21 also are shown as having a radius $r_1$ that is generally larger than the radius $r_2$ of the small coils 22. It should be noted that "coils" in the context of the present invention can take on a variety of shapes as described above and is not intended to be limited to cylindrical shapes. For embodiments using alternate shapes the reference "$r_1$" can be considered as referencing the average distance between a center point of the projection radially out to peripheral points about the periphery of the projection. A preferred embodiment also features longitudinally extending (preferably continues and consistent in dimension but for rounded ends) ridge extensions 23 (23*a* front and 23*b* back).

Figure 10:
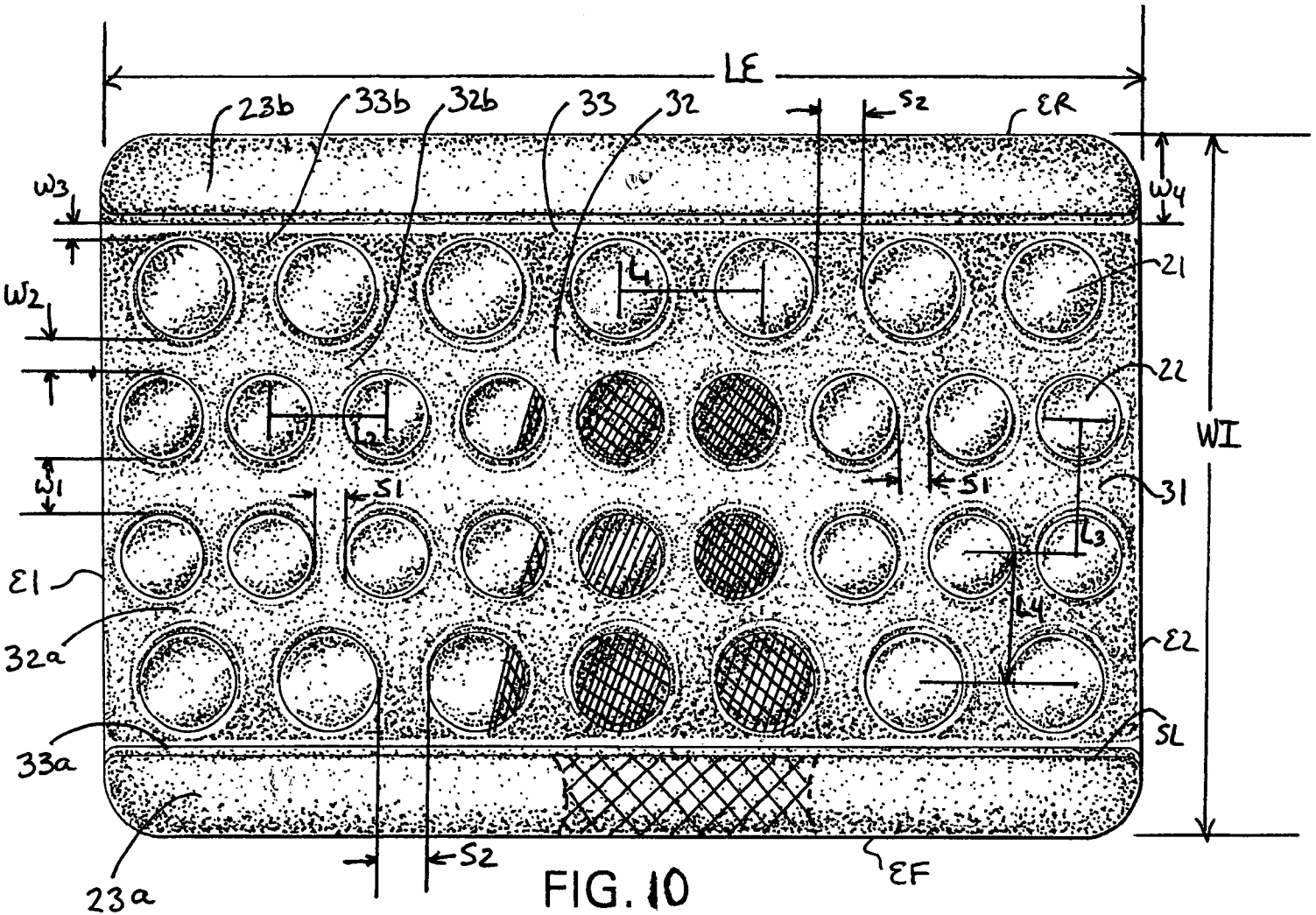
FIG. 10 shows a similar view as that in FIG. 4 with an illustration of a sample pattern of active support projections versus non-active support projections.

Longitudinally extended recesses or furrows 31, 32, and 33, as best seen in FIG. 10, extend, respectively, between the interior rows of small coils 22, between the adjacent rows of large/small coils (21, 22) and between the large coil rows and adjacent ridge extension (21, 23). Furrow 31 has a width of $w_1$, furrows 32 have a width $w_2$ (with 32*a* representing front and 32*b* the rear) and furrows 33 have a width $w_3$ (with front 33*a*—representing the front and 33*b* the rear) are formed.

As illustrated, in a preferred embodiment ridges 23 (23*a* represents front ridge and 23*b* the rear ridge), which preferably protrude upwardly and extend along the full length of respective longitudinal front and rear side edges EF, ER of the pillow's upper surface 25, extend from the upper surface 25 at a height of $h_3$ relative to the upper surface 25 of cushion 20.

FIG. 10 further illustrates the longitudinal spacing $S_1$ between adjacent small coils 22 in a row, while $S_2$ represents the longitudinal spacing between large coils 21 along a longitudinal line. In the preferred symmetrical arrangement, respective $S_1$ and $S_2$ values are the same in both the front section FS and the rear section RS, although, as noted, various non-symmetrical arrangements are also featured under the present invention by way of, for example, varying the front and rear sections' respective large and small coil sizes and/or spacing and/or projection numbers and/or widthwise furrow distance. Because of the preferred different size of coils 21 and 22 and respective spacing, a staggered arrangement is formed between rows of large and small coils and there is avoided, in a preferred embodiment, a continuous, linear widthwise extending furrow. The longitudinal end edge (E1 or E2) to an adjacentmost large coil 21 or small coil 22 is preferably equal to respective spacings $S_1$ and $S_2$. Also, FIG. 10 illustrates the center to center longitudinal distance $L_1$ between adjacent large coils and $L_2$ for the center to center spacing between small coils 22. $L_3$ represents the center to center widthwise distance between the rows of small coils and $L_4$ the widthwise distance between rows of small coils and large coils.

Figure 4:
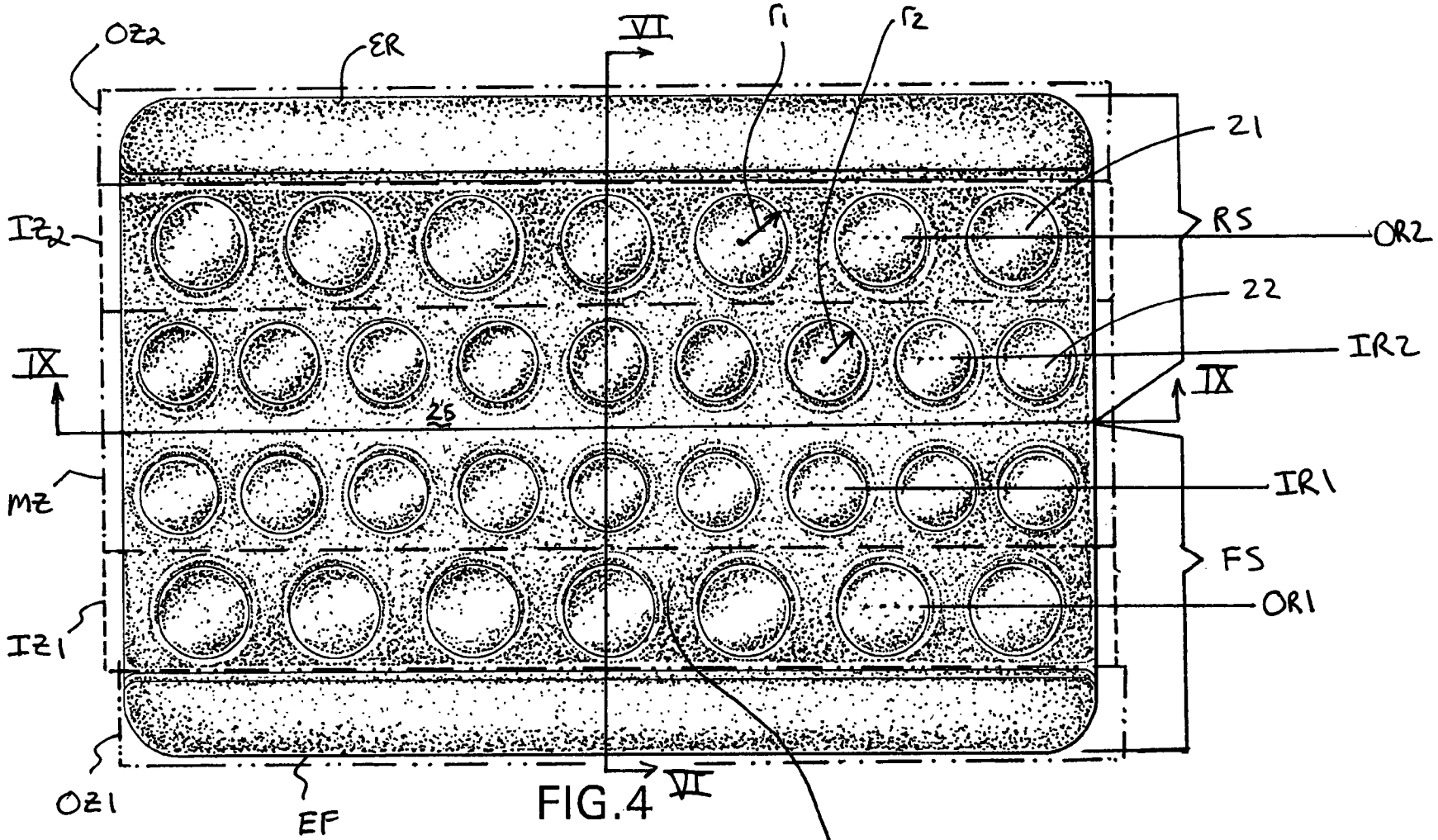
FIG. 4 shows a top plan view of the pillow of FIG. 1.

As shown in FIG. 4 the cushioning device 20 includes multiple zones (OZ1, OZ2, IZ1, IZ2, MZ), preferably the cushioning device 20 includes at least 2 different zone types with each zone having a different degree of support (e.g., CFD firmness value). In a preferred embodiment, there are at least two different zone types in each of a front section and a rear section of the pillow's exposed upper surface, as in 3 different zone types in each of a front and a rear section as illustrated and described below. For example, FIG. 5 shows pillow 20 with the interior most zone type of each of the front and back sections preferably being of a common type to define an intermediate pillow head support zone MZ (a 5-zone pillow with two outer, two intermediate and one inner).

As shown in FIG. 4, a preferred embodiment of the cushioning device has at least one head contact surface CS of a multi-zone type, (e.g., an upper multi-zone contact surface with either a smooth or contoured uni-zone surface or another multi-zone head contact surface for when the pillow is flipped). Thus, FIG. 4 illustrates contact surface CS with outer zones (OZ1 And OZ2), which include the elevated side ridges 23*a* and 23*b*; intermediate zones (IZ1 and IZ2) which include the outer rows (OR1 and OR2) of large coils 21, and the middle zone MZ, which includes at least one inner row and preferably two inner rows (IR1 and IR2) of small coils 22. Preferably, the outer zones (OZ1 and OZ2) with end ridges are firmer (e.g. have a higher CFD or IFD valve) than the intermediate zones (IZ1 and IZ2) which are, in turn, preferably firmer than the middle zone.

Figure 5:
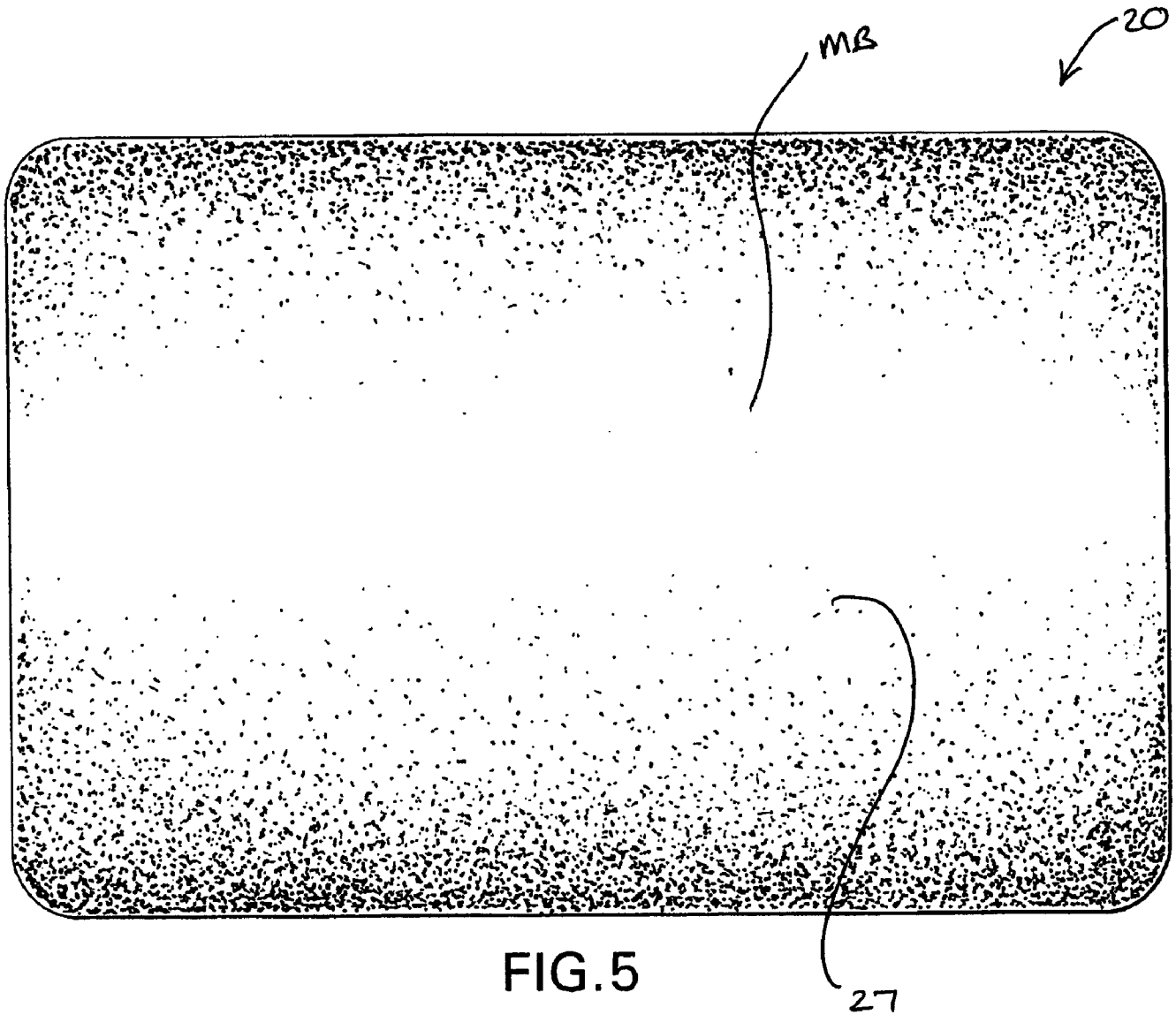
FIG. 5 shows a bottom plan view of the pillow of FIG. 1.

FIG. 5 shows the bottom surface 27 of the cushioning device 20. As seen in FIG. 5, the bottom surface 27 is preferably rectangular in shape, but can be formed to be of any known pillow shape. The bottom surface 27 can be flat or convex in either or both of the widthwise and lengthwise directions. Preferably, the bottom surface 27 is generally planar (e.g. an intermediate area that is planar with slightly tapering or curving up corner regions and slightly curving up lengthwise front and rear edges which come together to meet the contacting upper surface). This arrangement provides the option of a second, planar head contact surface supported underneath by the illustrated exposed surface with projections 21 and 22.

As shown in FIG. 4, the cushioning device 20 is preferably rectangular in shape. The longitudinal length of the cushioning device LE is illustrated as well as width WI. Preferably LE is 12 to 36 inches, more preferably 16 to 30 inches, and more preferably 20-26 inches. The width WI of the cushioning device 20 is preferably 8 to 30 inches, preferably 12 to 24 inches, and more preferably 14 to 18 inches. It should be noted that the dimensions and values given in the present application, both above and below, are not intended to be limiting, but are provided to facilitate an enhanced understanding of relative sizing and arrangements of components of preferred embodiments of the invention.

Figure 6:
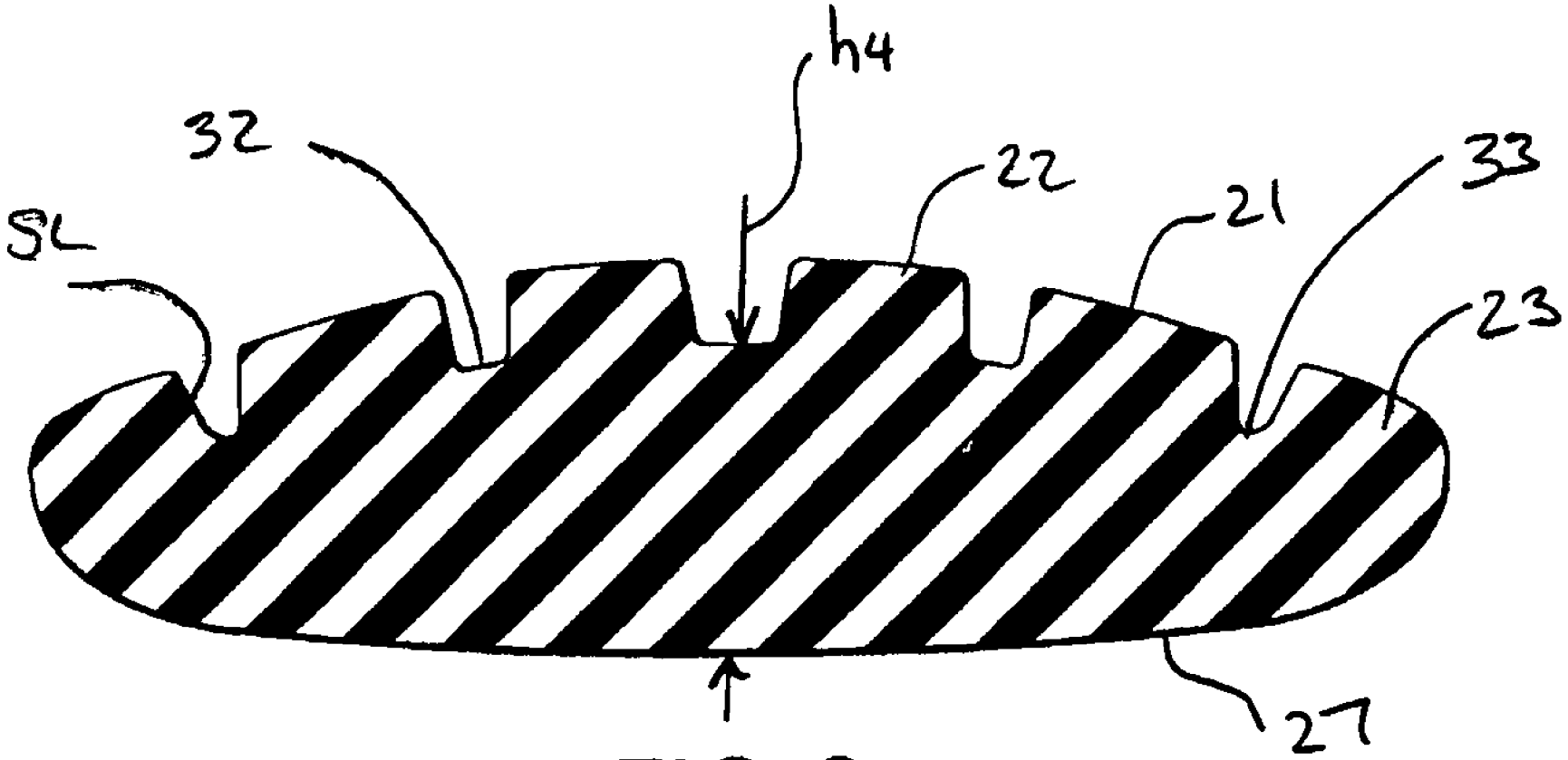
FIG. 6 shows a cross-sectional view of the pillow of FIG. 4 taken along cross-section line VI-VI.

The height of the main body of the cushioning device, as measured from the lowest portion of the bottom surface 27 to the highest top surface portion of the pillow, in which, in the illustrated embodiment, is the middle or center portion of the cushioning device 20, represents the highest level for the convex upper surface 25, is designated by reference $h_4$ in FIG. 6. The side and end regions are preferably equal to or lesser in height (e.g. converging end and/or side and/or corner-side walls) although alternate arrangements are also possible under the present inventor such as having the ridges 23*a*, 23*b* as the highest pillow components with or without a central depression. Some values for $h_4$ as well as many of the other referenced dimensions and values are provided below in Table II.

In a preferred embodiment, the elevated side ridges 23*a*, 23*b* have a height ($h_3$) relative to the upper surface 24 of the cushioning device 20 and extend continuously at a common height (e.g., no breaks or depressions along length) along their full length which length is shown to be commensurate with the overall longitudinal length of the pillow front edge LE. Also, ridges 23*a* and 23*b* preferably extend straight or non-curved. Ridge extension variations are also featured under the present invention as in an intermediate, U-shaped neck cradle or a convex planar profile as with a shoulder reception cavity. The illustrated ridges 23*a* and 23*b* are the same in both the front and rear sections FS, RS, although the present invention also features alternate arrangements as in one being higher and/or different in configuration, and/or thicker in width than the other, within preferably a 30% maximum deviation. From the interior, planar side wall SL extending up to height $h_3$, the exterior surface of ridges 23*a* and 23*b* include a generally planar section which extends into a convex surface that bridges the top and side surfaces of the pillow in the widthwise direction defines the front (or rear) side wall of the pillow. The end walls $E_1$ and $E_2$ are preferably generally vertical and planar. The height ($h_3$) of the side ridges 23*a*, 23*b* preferably gradually tapers from a highest point which faces the coils 21, 22 toward the respective outer, front and rear convex side walls of the cushioning device 20. The large coils 21 protrude from the upper surface 25 of the cushion 20 at a height ($h_1$) with some illustrative values provided in Table II. As shown in FIG. 1, the small coils 22 protrude from the upper surface 25 of the cushion 20 at a height ($h_2$) and, preferably, the height ($h_2$) of the small coils 22 is equal to or greater than the height ($h_1$) of the large coils 22. If greater, the height of the small coils 22 is preferably 0.1 to 0.4 inches greater than the height of the large coils 21, and more preferably 0.2 to 0.3 inches greater. The large coils 21 have a top planar surface 41 that is preferably circular in shape. The small coils 22 also have a top surface 42 that is preferably circular is shape. However, the top surfaces 41, 42 could be of other shapes, such as oval or a grooved "Roman" column shape as well as textured or convoluted rather than the current preferred smooth upper contact surface. Illustrative values for the radius ($r_1$) of the top surface 41 of the large coils 21 are presented in Table II. The radius ($r_1$) of the top surface 41 of the large coils 21 is preferably 0.4 to 0.7 inches greater than the radius ($r_2$) of the top surface 42 of the small coils 22, and more preferably 0.5 to 0.6 greater. Preferably the large coils 21 all have substantially the same height ($h_1$) and substantially the same top surface 41 radius ($r_1$). In addition, preferably, the small coils 22 all have substantially the same height ($h_2$) and substantially the same top surface 42 radius ($r_2$). The relative height and radius values also provide for volume variations between the small and large coils with Table II providing illustrated volume values for the small and large coils.

During direct compression with the head this volume is preferably reduced by at least 75% relative to the exposed surface of the main body MS and more preferably 100% relative to compression levels of at least the heavier central contacting area of the head. In other words, the 100% compression value coils are designed to compress completely down such that their upper contact surface is commensurate with the upper contact surface of the main body (convex surface 25 in the illustrated embodiment) or even slightly below that surface depending on the contact component of the user's head).

In a preferred embodiment, the cushioning device 20 includes four rows (OR1, OR2, IR1, and IR2) of coils 21, 22 as shown in FIG. 4. Preferably, the outer rows (OR1 and OR2) are formed of large coils 21 and the inner rows (IR1 and IR2) are formed of small coils 22. Preferably, the outer rows (OR1 and OR2) include 4 to 15 large coils 21, more preferably 5 to 12 large coils 21, and more preferably 7±1 large coils 21. In addition, the inner rows (IR1 and IR2) preferably include 6 to 18 small coils 22, more preferably 8 to 14 small coils 22, and more preferably 9±1 small coils 22, and have a greater number of coils per row as compared to a row of large coils.

Longitudinally extending furrows or grooves 31, 32 and 33 between the coil rows and ridge extension are illustrated in FIG. 10. Longitudinal furrow 31 formed between adjacent rows IR1 and IR2 of coils 21 and has a width $w_1$. Longitudinally extending furrows 32 are formed between adjacent large coil, small coil rows or between an IR row and an OR and each has a width of $w_2$. Longitudinally extending rows 33 are formed between a large coil row and adjacent ridge extension and each have a width $w_3$. Also, the coil to coil spacing within a row of small coils is shown in FIG. 10 with spacing $S_1$. This spacing is preferably consistent for the entire length of the row IR1, IR2. Illustrative values of the spacing $S_1$ formed between each adjacent small coil 22, (as well as between end coils and adjacent side wall of the pillow) are provided in Table II and have values preferably smaller than that between the large coils. FIG. 10 further illustrates spacing $S_2$ formed between adjacent large coils with some preferred values presented in Table II.

Figure 7:
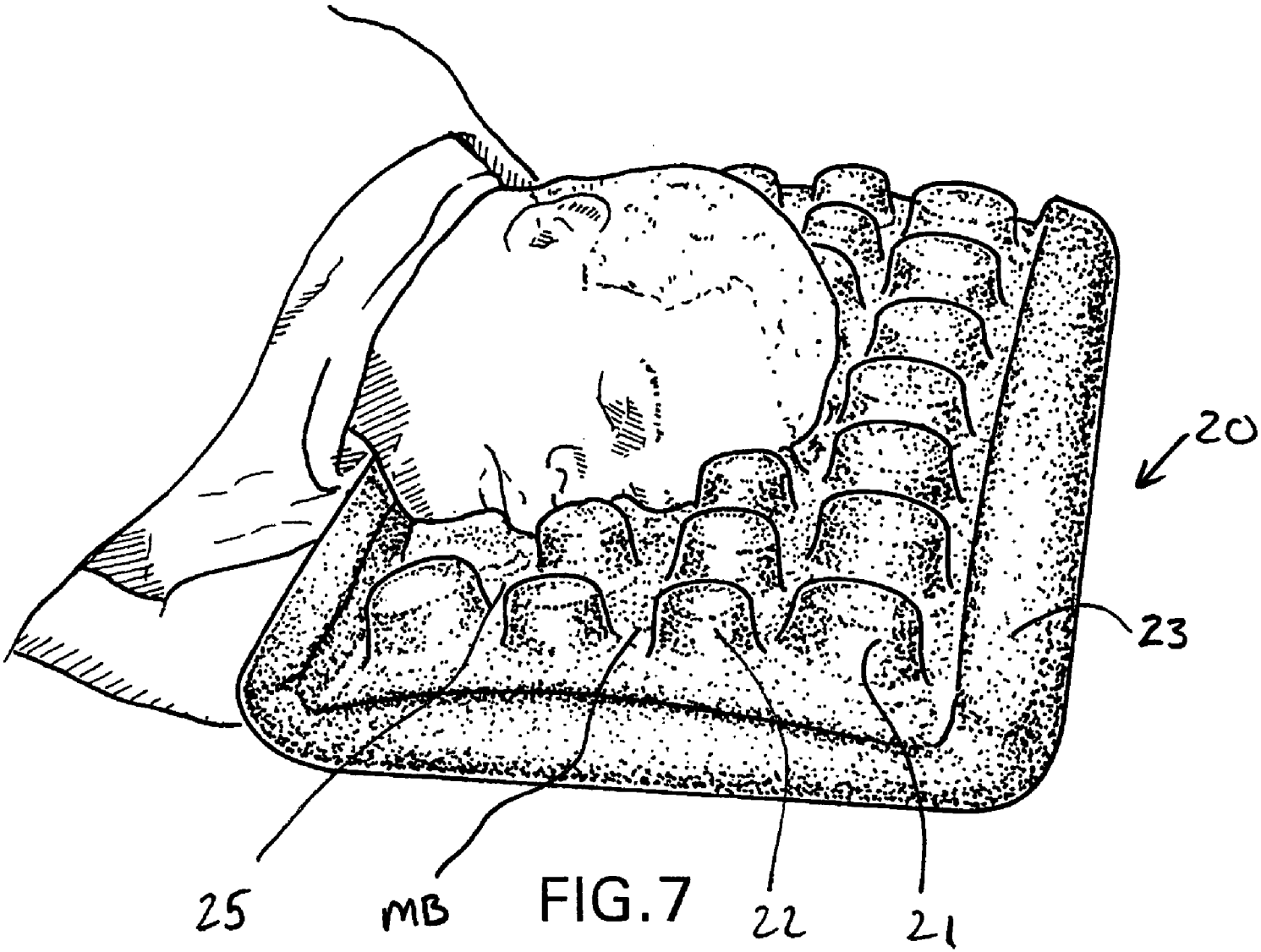
FIG. 7 shows a user's head resting in the center portion of the pillow of FIG. 1 (with the typically involved outer cloth cover removed for clarity)
Figure 8:
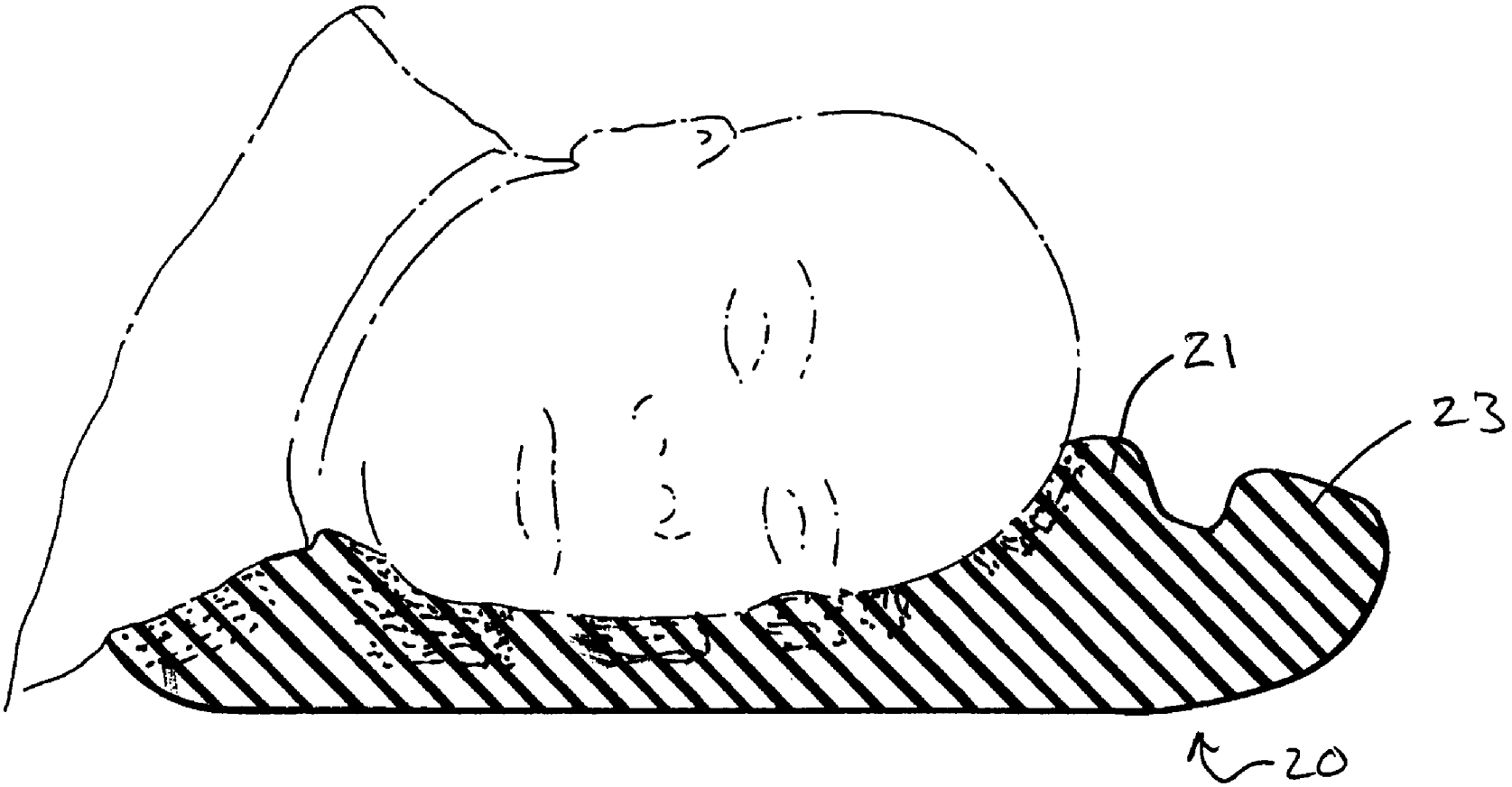
FIG. 8 shows a user's head compressing the cross-sectional view of FIG. 6.
Figure 9:
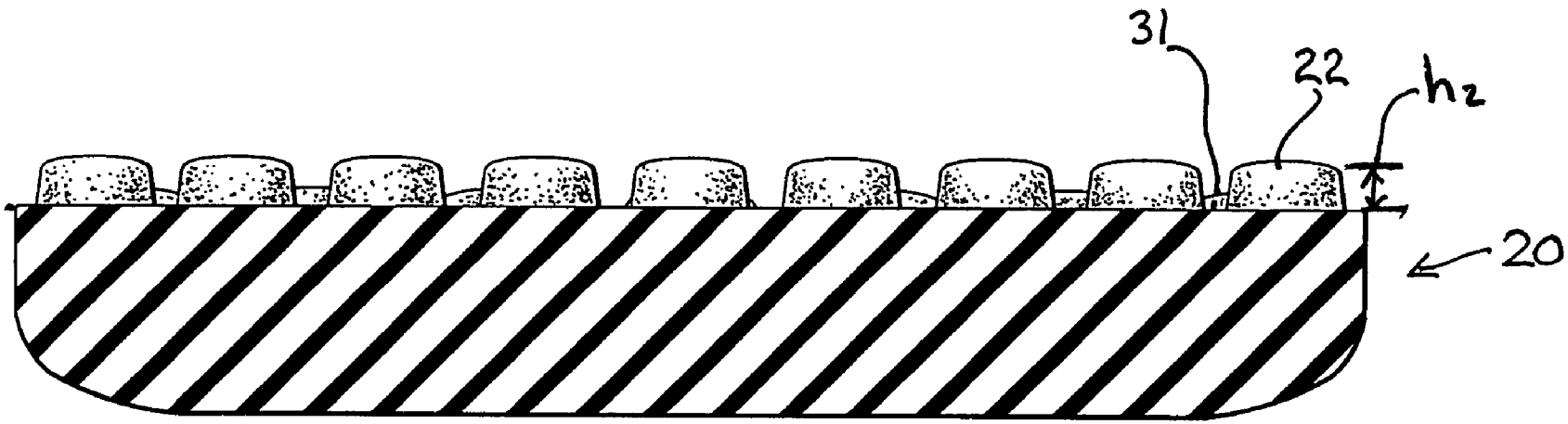
FIG. 9 shows a cross-sectional view of the pillow of FIG. 1 taken along cross-section line IX-IX in FIG. 4.

With reference to FIGS. 7, 8 and 10 there is illustrated the cushion 20 in a use mode. FIG. 10 shows criss-cross hatching to illustrate a typical head and neck/coil contact arrangement (either in a side (ear) contact state or back of head or face down contact state). As shown in FIG. 10, two large coils within one row and two small coils within two rows (total of 4 small coils and two large coils) are fully contacted over their entire upper, contact surface. For an average adult head size, the coils are arranged such that portions of additional small coils are contacted (e.g., an additional 0.25 to 1 additional small coil total in each row). There is typically further involved a partial large contact with for example the chin of the user and the ridge extension comes in contact with the neck while avoiding contact with the head other than, for example, contact against sloping wall SL at the underside of the chin.

Also, the support characteristics are preferably arranged such that the head compresses the coils entirely into the main body at the heavier contact portions of the head whereupon the main body assists in the support, but to a lesser extent then the fully compressed foam coils. The areas such as the nose and outer extremities of the head such as the exterior of the chin preferably come in contact with coils but may or may not fully compress the coils (potential minor air gape to facilitate heat dissipation). The ridge 23 in contact with the neck (shown by cross-hatching in FIG. 10 on ridge longitudinal portion of 23*a*) is preferably generally equivalent to 2 large coil diameters plus 2 large coil spacings $S_1$ (e.g., $(4\times r_1)+(2\times S_1)$. Variations are also possibly but less preferable, such as increasing the height of the coils ($L_1$ and/or 22) and/or the compression characteristics to provide for some clearance (e.g., less than ¼ inch) between the central, heavier portions of a supported head and the main body 25 contact surface CS. However, to take advantage of the preferred conforming visco-elastic material, contact with both the compressed coils and main body surface is preferred (with the coils promoting enhanced support characteristics with their relatively high surface area contact coils together with the preferred main body contact, but to a lesser degree of compression due to the coiled support adsorbing some of the head weight). Thus areas of the main body are not compressed down to the same level as would occur if the projections were not present, but there is still provided conforming support to the contact portions of the head. The ridge compression distance characteristics are also preferably similar to that of the coils in that there is compression down to the level of the main body upper surface 25 such that the main body provides conforming support in the border region where the ridge extension comes in contact with the neck of the user (e.g., width $w_4$ is preferably designed to achieve full or greater than a majority neck length support contact while avoiding skull support). For a user with the head supported on its backside and the face looking up, a similar contact arrangement is provided (e.g., two large coils and four small coils) with typically less third large coil contact, if any, and a similar peripheral small coil contact arrangement.

FIG. 7 illustrates a full compression state for the coils supporting a user's head as well as an example of the number of coils contacted and the head and needs relationship with the ridge extension 23. FIG. 8 shows a similar view as that in FIG. 7, but with the user's head moved up farther towards the rear. As seen in FIG. 8, the coils are entirely compressed providing areas of increased support below the main body surface (see the dashes representing the compressed foam below the expansion projection zone for each projection). Also, as seen from FIG. 8, the outer, rear row of coils is tilted down to help properly position the user's head relative to the other coils and ridge extension (i.e., helps block the head from shifting too much toward the rear of the pillow).

The total height of TH of the pillow extends between bottom surface 27 and an imaginary curved line contacting the upper surface of the coils (e.g., TH is equal to the main body height $h_4$ plus the height of the height of the coils if the same or the height of the maximum height coil if there is any difference in coil height) Some preferred overall height TH values are provided in Table II).

TABLE II

| Referenced pillow component for which preferred values are given (in inches unless noted otherwise) | Preferred Range Values | Preferred Intermediate Range Values | Preferred Value(s) |
|---|---|---|---|
| $h_1$ large coil height | 0.5 to 2.5 | 0.75 to 1.25 | 1.0 ± 0.1 |
| $h_2$ small coil height | 0.5 to 2.5 | 0.75 to 1.5 | 1.0 ± 0.2 |
| $r_1$ large coil radius | 0.7 to 1.5 | 0.8 to 1.3 | 1.0 ± 0.1 |
| $r_2$ small coil radius | 0.5 to 1.25 | 0.6 to 0.9 | 0.7 ± 0.1 |
| $w_1$ furrow width between small coil rows | 0.25 to 3 | 0.5 to 1.5 | 1.0 ± 0.1 |
| $w_2$ furrow width between small/larger coil rows | 0.20 to 2.8 | 0.3 to 1.2 | .80 ± .2 |
| $w_3$ furrow width between ridge and large coil rows | 0.2 to 1.5 | 0.5 to 1.0 | 0.75 ± .2 |
| $w_4$ ridge extension width | 0.5 to 3.5 | 1.0 to 3.0 | 2.0 ± .3 |
| $S_1$ spacing between small coils | 0.25 to 1.0 | 0.3 to 0.7 | 05 ± 0.1 |
| $S_2$ spacing between large coils | 0.25 to 1.5 | 0.5 to 1.0 | 0.75 ± 0.1 |
| $L_1$ longitudinal center to center small coils | 1.5 to 4.5 | 2.0 to 4.0 | 2.5 ± .3 |
| $L_2$ longitudinal center to center large coils | 2.0 to 5.0 | 2.5 to 4.5 | 3.25 ± .3 |
| $L_3$ widthwise center to center small coil rows | 2.0 to 5.0 | 2.5 to 4.5 | 3.25 ± .3 |

TABLE II-continued

| Referenced pillow component for which preferred values are given (in inches unless noted otherwise) | Preferred Range Values | Preferred Intermediate Range Values | Preferred Value(s) |
|---|---|---|---|
| $L_4$ widthwise center to center small/large coil rows | 2.25 to 5.25 | 2.75 to 4.75 | 3.0 ± .3 |
| $V_S$ volume small coil (in3) | 0.4 to 12.25 | .85 to 3.80 | 1.5 ± .3 |
| $V_L$ volume large coil (in3) | .55 to 17.75 | 1.50 to 6.75 | 3.0 ± .3 |
| $V_R$ volume ridge extension (in3) | 10 to 50 | 20 to 45 | 35 ± .5 |
| $h_3$ height ridge extension | 0.5 to 2.0 | 0.75 to 1.25 | 1.0 ± 0.1 |
| $h_4$ height main body | 2.0 to 7.0 | 2.5 to 5.5 | 3.0 ± .5 |
| TH overall pillow height | 2.5 to 8.0 | 3.0 to 6.0 | 4.0 ± .5 |
| LE overall pillow length | 8 to 30 | 15 to 26 | 22.75 ± .2 |
| WI overall pillow width | 8 to 30 | 12 to 24 | 16.0 ± 2 |

It should be emphasized that the above-described embodiments of the present invention, particularly, and "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to included herein within the scope of the disclosure and the present invention and protected by the following claims.

What is claimed is:

1. A pillow, comprising:

a foam main-body, a plurality of foam projections extending off of said foam main-body, said projections being arranged in a laterally central support characteristic zone, an edge support characteristic zone, and at least one laterally intermediate support characteristic zone positioned laterally between said central support characteristic zone and said edge support characteristic zone, and said edge support characteristic zone including a ridge extension, and said at least one intermediate support characteristic zone being comprised of a plurality of independent projections having a lateral width greater than height extension off a supporting upper surface of said main-body, and wherein said ridge extension continuously extends longitudinally across a plurality of said independent projections in said at least one intermediate support characteristic zone, and said independent projections in said at least one intermediate support zone are laterally spaced from said ridge extension by a longitudinally extending exposed region of the upper surface of said main-body, and said central, edge and laterally intermediate support characteristic zones define different support characteristic zones, and wherein said pillow has a maximum height in a central support characteristic zone of said pillow, and said pillow is formed as a monolithic, visco-elastic foam body.

2. The pillow of claim 1, wherein said pillow includes a first row of cylindrical foam projections in said central support characteristic zone and a second row of cylindrical foam projections in said at lest one intermediate support characteristic zone and top surfaces of the cylindrical projections in the first row have a smaller radius than that of top surfaces of the cylindrical projections in the second row.

3. The pillow of claim 1 wherein said central support characteristic zone includes a first group of projections that include multiple rows of a first size projection and said at least one intermediate support characteristic zone includes a second group of projections that includes a row of a second size projection.

4. The pillow of claim 3 wherein said first group of multiple rows of projections include a pair of laterally spread apart longitudinally extending rows of projections in a central region of the upper surface of said foam main-body, and wherein there is a pair of said intermediate support characteristic zones each comprising a set of said second group projections, with each set comprising longitudinally extending row of projections positioned to opposite lateral sides of the pair of the longitudinally extending rows of the projections of said first group in the central support characteristic zone.

5. The pillow of claim 4 wherein the projections of said first group are smaller in volume than the projections of said second group.

6. The pillow of claim 5 wherein the projections within said first group are of a common size and configuration within said first group, and wherein the projections within said second group are of a common size and configuration within each set of said second group of projections.

7. The pillow of claim 6 wherein said projections in each of said first and second groups are cylindrical projections.

8. The pillow of claim 1 wherein said main-body and projections are formed of a visco-elastic foam material having a density range of 2.0 to 3.0 pounds per cubic foot (pcf).

9. The pillow of claim 8 wherein said projections of said first group and said projections of said second group are of a common general shape.

10. The pillow of claim 1, wherein said upper surface of said main-body has a convex curvature which defines the maximum height central support characteristic zone of said pillow.

11. The pillow of claim 10 wherein said convex curvature extends in a lateral direction fully between front and rear longitudinal edges of said pillow.

12. The pillow of claim 11 wherein said central support characteristic zone includes a plurality of projections within a first group that include cylindrical projections, and said intermediate support characteristic zone includes a plurality of projections of a second group that includes cylindrical projections that are laterally external to said first group of projections and are of a larger radius than cylindrical projections in said first group.

13. The pillow of claim 1 wherein the projections have a lateral direction width that is greater than a corresponding projection height.

14. The pillow of claim 1 wherein said central support characteristic zone is less firm in support than said intermediate support characteristic zone.

15. The pillow of claim 1, wherein said projections of said intermediate support characteristic zone have a greater lateral width than that of said ridge extension.

16. The pillow of claim 1, wherein an upper surface of said projections of said intermediate support characteristic zone is at a pillow height level higher than an uppermost surface of said ridge extension.

17. The pillow of claim 1, wherein all projections are independent projections that are separated by exposed regions of an upper surface of said main-body, and wherein there is a longitudinally extending exposed region extending for a length commensurate with said ridge extension, and said longitudinally extending exposed region is positioned between said ridge extension and an adjacent most row of said independent projections of said intermediate support characteristic zone.

18. A pillow, comprising:

a main-body, projections arranged in a plurality of rows and extending off said main-body, and said projections including a first type of projection having a first support characteristic, a second type of projection having a second support characteristic different than said first support characteristic and a third projection type, with said first, second and third projection types being arranged on said main-body to define first, second and third different support characteristic zones, and said first and second types of projections are isolated from one another within each respective zone so as to expose regions of the main-body which extend along respective projection base-to-main-bogy contact edging, wherein said first and second projection types have a density range of foam forming said first and second projection types of 2.0 to 3.0 pounds per cubic foot (pcf) and wherein said first projection type is more centrally positioned than said second projection type, and wherein said third projection type includes a ridge extension extending along a forward or front longitudinal edge of said main-body past a plurality of projections in an adjacent row, and said ridge extension being uninterrupted over the longitudinal length of extension, and wherein said main-body and projections are formed of a common foam material to provide a monolithic foam pillow, and wherein said first and second projection types have upper exposed contact surfacing with portions of said exposed contact surfacing defining different respective height support levels in said first and second support characteristic zones.

19. The pillow of claim 18 wherein said first type of projection includes laterally spaced apart longitudinally extending rows of projections and said second type of projections includes a longitudinally extending row of projections, and wherein said first and second projection types have compression force deflection (CFD) values of 0.35 to 0.55 lbs and 0.60 to 0.80 lbs to compress said projection types 50%, respectively.

20. The pillow of claim 19 wherein said third projection type further comprises a second longitudinally extending ridge extension.

21. The pillow of claim 20 wherein said first, second and third projection types are arranged laterally in a sequence of first ridge extension, first longitudinal row of second type projection, pair of longitudinal rows of first type projections, second longitudinal row of second type projections and second ridge extension.

22. The pillow of claim 18 whereas said pillow has a symmetric relationship with respect to projection types about a centrally located longitudinal cross-section line.

23. The pillow of claim 18 wherein said first projection type includes cylindrical projections and said second projection type includes cylindrical projections less centrally positioned than the projection of the first projection type, and wherein the projection of said first projection type are smaller in radius and greater in number per longitudinal row than the cylindrical projections of said second projection type.

24. The pillow of claim 18, wherein:

said projections and ridge extension are spaced apart to define exposed regions in the upper surface of said main-body and are in an arrangement that provides for molding of a final configuration molded pillow, and wherein said ridge is uninterrupted and extends longitudinally across a complete front edge of said main-body and there is a longitudinally extending exposed region extending between said ridge extension and an adjacent most row of projections of said second type of projection, and which longitudinally extending exposed region extends in a longitudinal length commensurate with that of said ridge extension.

25. The foam pillow of claim 18, wherein:

said main-body has a longitudinal length and a lateral width and a convex upper surface, and a plurality of said projections extend up off said convex upper surface, and wherein said plurality of projections extending off of said main-body are independent projections that are isolated from one another relative to an underlying and supporting exposed main-body surface and thus free from contact with each other.

26. The pillow of claim 18 wherein said pillow has a generally rectangular outline with laterally spaced forward and rearward edging, and the exposed portion of the upper surface of said main-body within the generally rectangular outline occupies about 10 to 30% of the area of the generally rectangular outline.

27. The pillow of claim 18 wherein said pillow is a monolithic solid block of viscoelastic material.

28. The pillow of claim 18, wherein all projections extending off said main-body extend off an upper surface of said main-body such that said exposed regions are provided on said upper surface and said exposed regions represent 10 to 30% of the upper surface of said pillow, and said exposed regions including a longitudinally extending exposed region located between an internal edge of said ridge extension and an adjacent most row of projections of said second type.

29. The pillow of claim 18 wherein the lateral extension length of said ridge extension is less than that of projections in an adjacent most row of projections of said second type.

30. The pillow of claim 18 wherein said ridge extension has a maximum height upper surface that lies below a maximum height upper surface of projections of said second type.

31. The pillow of claim 18 wherein said ridge extension has an exterior side surface that curves inward in a direction toward said intermediate support zone.

32. The pillow of claim 18, wherein said first support characteristic zone defines a higher exposed contact surfacing level than that of said second support characteristic zone.

33. A head pillow, comprising:

a main-body having an upper surface;

a plurality of projections extending upwardly off the upper surface of said main-body and arranged in different support zones, with said support zones having different support characteristics with respect to each other, and said support zones including a central support zone arranged in a central region located between a front edge of the pillow and a rear edge of the pillow, an edge ridge support zone extending continuously along a front edge of said pillow and comprising a ridge extension projection having an inward ridge portion extending up off from the upper surface of the main-body, and said head pillow further comprising a laterally intermediate support zone which includes a longitudinal series of projections that are positioned laterally between said central support zone and said edge ridge support zone, and wherein said inward ridge portion is laterally separated from said longitudinal series of projections in said intermediate support zone by an exposed, longitudinally extending portion of the upper surface of said main-body, and wherein said inward ridge portion extends uninterrupted across a plurality of projections in said longitudinal series of projections, and said head pillow is formed of a solid, common block of viscoelastic foam so as to provide a monolithic, viscoelastic head pillow, said projections of said central and intermediate support zones presenting different respective height contact support levels in said central and intermediate support zones.

34. The head pillow of claim 33 wherein said longitudinal series of projections include projections having a lateral width greater than that of said ridge extension projection.

35. The head pillow of claim 33 wherein said central support zone includes a plurality of projections that have a smaller lateral width than that of projections in said intermediate support zone and which are arranged in longitudinal rows of greater projection number than a longitudinal row of said projections in said intermediate support zone.

36. The head pillow of claim 33 wherein said projections are designed in height and material such that some of said projections are completely absorbed into said main-body due to user head contact and other projections or projection portions contacting the user head remain extended above said upper surface to promote air circulation in the monolithic foam head pillow.

37. The pillow of claim 18 wherein said ridge extension has an exterior side surface that curves inward in a direction toward said intermediate support zone.

38. A head pillow comprising:

a main-body having an upper surface;

a plurality of projections extending upwardly off the upper surface of said main-body and arranged in different support zones, with said support zones having different support characteristics with respect to each other and said support zones including a central support zone arranged in a central region located between a front edge of the pillow and a rear edge of the pillow, an edge ridge support zone extending continuously along a front edge of said pillow and comprising a ridge extension projection having an inward ridge portion extending up off from the upper surface of the main-body, and said head pillow further comprising a laterally intermediate support zone which includes a longitudinal series of projections that are positioned laterally between said central support zone and said edge ridge support zone, and wherein said inward ridge portion is laterally separated from said longitudinal series of projections in said intermediate support zone by an exposed, longitudinally extending portion of the upper surface of said main-body, and wherein said inward ridge portion extends uninterrupted across a plurality of projections in said longitudinal series of projections, and said head pillow is formed of a solid, common block of viscoelastic foam so as to provide a monolithic, viscoelastic head pillow, and wherein a maximum height head contact surface of said ridge extension lies below a maximum height head contact surface presented by said longitudinal series of projections in said intermediate support zone.

* * * * *